US009992589B2

(12) United States Patent
Ochsenbein et al.

(10) Patent No.: US 9,992,589 B2
(45) Date of Patent: Jun. 5, 2018

(54) ITE HEARING AID AND METHOD OF MANUFACTURING THE SAME

(71) Applicant: SONOVA AG, Stäfa (CH)

(72) Inventors: André L. Ochsenbein, Wolfhausen (CH); Jan Angst, Hirzel (CH); Erich Dittli, Reichenburg (CH); Gabriel Perez, Maennedorf (CH); Daniel Probst, Uerikon (CH)

(73) Assignee: Sonova AG, Staefa (CH)

( * ) Notice: Subject to any disclaimer, the term of this patent is extended or adjusted under 35 U.S.C. 154(b) by 0 days. days.

(21) Appl. No.: 15/128,580

(22) PCT Filed: Mar. 24, 2014

(86) PCT No.: PCT/EP2014/055802
§ 371 (c)(1),
(2) Date: Sep. 23, 2016

(87) PCT Pub. No.: WO2015/144193
PCT Pub. Date: Oct. 1, 2015

(65) Prior Publication Data

US 2017/0111748 A1 Apr. 20, 2017

(51) Int. Cl.
*H04R 25/00* (2006.01)

(52) U.S. Cl.
CPC ..... *H04R 25/658* (2013.01); *H04R 25/602* (2013.01); *H04R 25/604* (2013.01); *H04R 2225/025* (2013.01); *H04R 2225/61* (2013.01)

(58) Field of Classification Search
CPC ..... H04R 25/00; H04R 25/60; H04R 25/65; H04R 2225/023; H04R 2225/025
USPC ..... 381/322, 324, 328
See application file for complete search history.

(56) References Cited

U.S. PATENT DOCUMENTS 4,860,362 A * 8/1989 Tweedle ..... H04R 25/65 156/258
5,878,147 A * 3/1999 Killion ..... H04R 1/406 381/313
6,327,370 B1 * 12/2001 Killion ..... H04R 25/407 381/312

(Continued)

FOREIGN PATENT DOCUMENTS

DE 81 06 942.1 U1 7/1982
DE 197 06 306 C1 10/1998

(Continued)

*Primary Examiner* — Suhan Ni
(74) *Attorney, Agent, or Firm* — David S. Safran

(57) ABSTRACT

An ITE hearing aid having a shell worn at least partially in a user's ear canal, a faceplate closing the shell at a side oriented towards the exterior of the user's ear, and at least one microphone housed in the shell and acoustically connected to ambience via a sound port formed in the faceplate. The faceplate has a cover element covering a cavity of the sound port in a direction normal to a main plane of the faceplate and a lateral sound opening in a wall extending normal to the main plane. The cover element is elevated above a surface region surrounding the cover element, with the sound port wall extending between the cover element and this surface region. The shell is designed, with regard to shape and size, in a manner that the hearing aid is manually removable from the ear canal without the need to use a tool.

14 Claims, 4 Drawing Sheets

(56) References Cited

U.S. PATENT DOCUMENTS

| | | | | |
|---|---|---|---|---|
| 7,245,733 | B2 * | 7/2007 | Saltykov | H04R 25/402 381/322 |
| 7,298,857 | B2 | 11/2007 | Shennib et al. | |
| 7,894,621 | B2 * | 2/2011 | Jensen | H04R 1/086 381/322 |
| 8,238,594 | B2 | 8/2012 | Sauer et al. | |
| 8,284,973 | B2 | 10/2012 | Gabathuler et al. | |
| 8,457,336 | B2 | 6/2013 | Ladabaum et al. | |
| 8,542,858 | B2 | 9/2013 | Flaig et al. | |
| 2012/0163643 | A1 | 6/2012 | Vestergaard et al. | |

FOREIGN PATENT DOCUMENTS

| | | | |
|---|---|---|---|
| DE | 10 2010 041 656 | A1 | 10/2011 |
| DE | 10 2011 006 417 | B3 | 8/2012 |
| EP | 1 587 344 | A2 | 10/2005 |
| EP | 1 439 733 | B1 | 1/2011 |
| WO | 2005/094122 | A1 | 10/2005 |

* cited by examiner

ITE HEARING AID AND METHOD OF MANUFACTURING THE SAME

BACKGROUND OF THE INVENTION

Field of the Invention

The invention relates to an ITE ("in-the-ear") hearing aid comprising a shell to be worn at least in part in the ear channel of the user, a faceplate being fixed at the shell for closing the shell at a side oriented towards the exterior of the user's ear, and at least one microphone housed in the shell and acoustically connected to ambience via a sound port.

Description of Related Art

When being worn by the user, an ITE hearing aid is exposed to cerumen and sweat, while the microphone has to be open towards ambience in order to pick up ambient sound with high efficiency. Therefore, it is necessary to provide the microphone opening with some kind of protection from cerumen and humidity in order to avoid clogging of the microphone opening. However, the evaluable space on the faceplate is very limited, and typically the faceplate is not only provided with microphone openings, but also with at least one element for manual adjustment of the hearing aid, such as a toggle switch. Typically, the microphone protection is provided as an element which is fixed within the microphone opening in the faceplate by an interference fit. However, it may happen that the microphone protection becomes loose by incorrect handling of the hearing aid, which then may result in clogging of the microphone opening with cerumen.

U.S. Pat. No. 8,457,336 B2 relates to a CIC ("completely-in-the-channel") hearing aid which is to be worn deeply within the ear channel for several weeks or months without having to be removed from the ear channel during that time. Insertion and removal of the hearing aid is done by an audiologist using a specific tool. The hearing aid comprises a microphone opening oriented towards the outer end of the ear channel, which microphone opening is covered by a separate cap element which, when fixed at the outer end of the housing of the hearing aid, leaves lateral openings for sound to be picked up by the microphone. A similar hearing aid is described in U.S. Pat. No. 7,298,857 B2.

U.S. Pat. No. 8,284,973 B2 relates to an ITE hearing aid comprising a faceplate having a microphone opening protected by a protection element to be inserted into the microphone opening which is designed as a blind hole, with the microphone protection being designed as a cylindrical, mushroom-shaped plug.

U.S. Pat. No. 8,238,594 B2 relates to an ITE hearing aid comprising a microphone opening into which a cover element provided with several small holes is inserted, with a water-repellant, sound-permeable membrane being bonded on the inner side of the cover element.

EP Patent Publication 1 439 733 B1 relates to an ITE hearing aid comprising a faceplate with a microphone opening into which a mesh-like filter element is removably inserted.

U.S. Patent Application Publication 2012/0163643 A1 relates to an ITE hearing aid comprising a faceplate which is provided with a laterally angled microphone opening covered by a protection element comprising a grid-type structure. A similar hearing aid is described in U.S. Pat. No. 8,295,522 B1.

U.S. Pat. No. 8,542,858 B2 relates to a BTE ("behind-the-ear") hearing aid comprising a rocker switch which is provided with lateral microphone openings, with the rocker switch extending above the surface of the BTE housing.

Gelman Patent Publication DE 10 2011 006 417 B3 relates to a BTE hearing aid comprising a bow-like element for protecting microphone openings in the housing from the hairs of the user; ambient sound reaches the microphone opening through laterally extending slots. The microphone openings are covered by a membrane. A similar hearing aid is described in German Patent Application Publication DE 10 2010 041 656 A1.

SUMMARY OF THE INVENTION

It is an object of the invention to provide for an ITE hearing aid which enables a high reliability of the function of the microphone(s) and which can be manufactured in an effective manner. It is a further object of the invention to provide for a corresponding manufacturing method.

According to the invention, these objects are achieved by an ITE hearing aid and a method of manufacturing such hearing aid as described herein.

By providing the sound port of the microphone(s) integral in a single piece with the faceplate, with the faceplate comprising a cover element for covering a cavity of the sound port in a direction normal to a main plane of the faceplate and a lateral sound opening in a wall extending substantially normal to the main plane of the faceplate, and with the cover element being elevated above the surface region of the faceplate surrounding the cover element, and with the wall comprising the lateral sound opening extending between the cover element and the surface region of the faceplate surrounding the cover element, the following benefits are achieved:

(1) the microphone opening is protected from contamination/clogging caused by the faceplate being touched by the fingers of a user in the direction perpendicular to the faceplate during handling of the hearing aid (the microphone opening is covered in a direction perpendicular to the faceplate), (2) the cover element cannot be lost during handling of the hearing aid, since it is integral with the faceplate; and (3) manufacturing is simplified due to the elimination of the need for a separate cover element. In particular, the overall microphone protection from cerumen is enhanced by the design of the sound port according to the invention, so that reliability of the microphone function is improved and the likelihood that the microphone is damaged by cerumen is reduced.

By "main plane" of the faceplate a plane is meant the plane which is oriented such that it extends essentially across the hearing aid and the ear channel when the hearing aid is inserted in the ear channel, i.e., the "main plane" extends substantially transverse with regard to the ear canal when the hearing aid is worn, and it extends substantially perpendicular to the longitudinal direction of the hearing aid.

Preferably, the hearing aid comprises a manually operable user interface element extending through an interface opening of the faceplate; for example, the user interface element may be a button operable in a direction normal to the main plane of the faceplate. Since for such hearing aid designs the faceplate is frequently touched by a finger of the user in a direction normal to the main plane of the faceplate, the laterally angled arrangement of the microphone opening according to the invention is particularly beneficial by providing for a maximum protection in the direction normal to the main plane of the faceplate.

Alternatively or in addition, the faceplate may comprise an opening covered by a battery lid and/or a volume control extending through an opening of the faceplate.

Preferably, the cavity of the sound port has a volume of at least 1 $mm^3$. Thereby, contamination of the microphone due to capillary effects can be minimized (capillary effects are reduced by providing such relatively large volume behind the actual sound opening).

Preferably, the hearing aid comprises two microphones, with a separate sound port being provided for each of the microphones, and with the two sound ports being arranged substantially symmetrically with regard to the interface opening. Preferably, the distance of the two sound ports is at least 6.0 mm; thereby the noise level in a beam forming mode of the microphones can be reduced.

Hereinafter, examples of the invention will be illustrated by reference to the accompanying drawings.

DETAILED DESCRIPTION OF THE INVENTION

The invention relates to an ITE hearing aid comprising a shell to be worn at least in part in the ear channel of a user, a faceplate being fixed to the shell for closing the shell at a side oriented towards the exterior of the user's ear, and at least one microphone housed in the shell and acoustically connected to ambience via a sound port. The shell is designed, with regard to its shape and size, in a manner that the hearing aid is manually removable from the ear channel without the need to use a tool (as opposed to the extended wear CIC hearing aid of the type described, for example, in U.S. Patent Application Publication 2010/0322452 A1, which can be inserted into and removed from the ear channel only by the audiologist using a specific tool).

Figure 1:
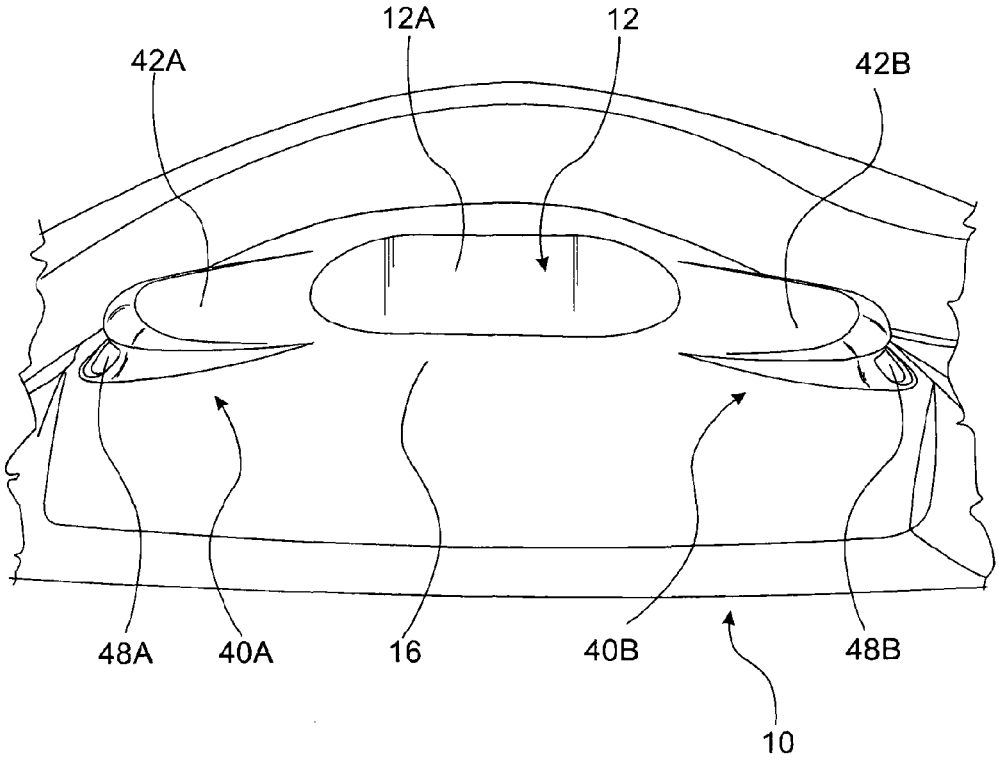
FIG. 1 is a perspective view of part of an example of a faceplate of an ITE hearing aid according to the invention.
Figure 2:
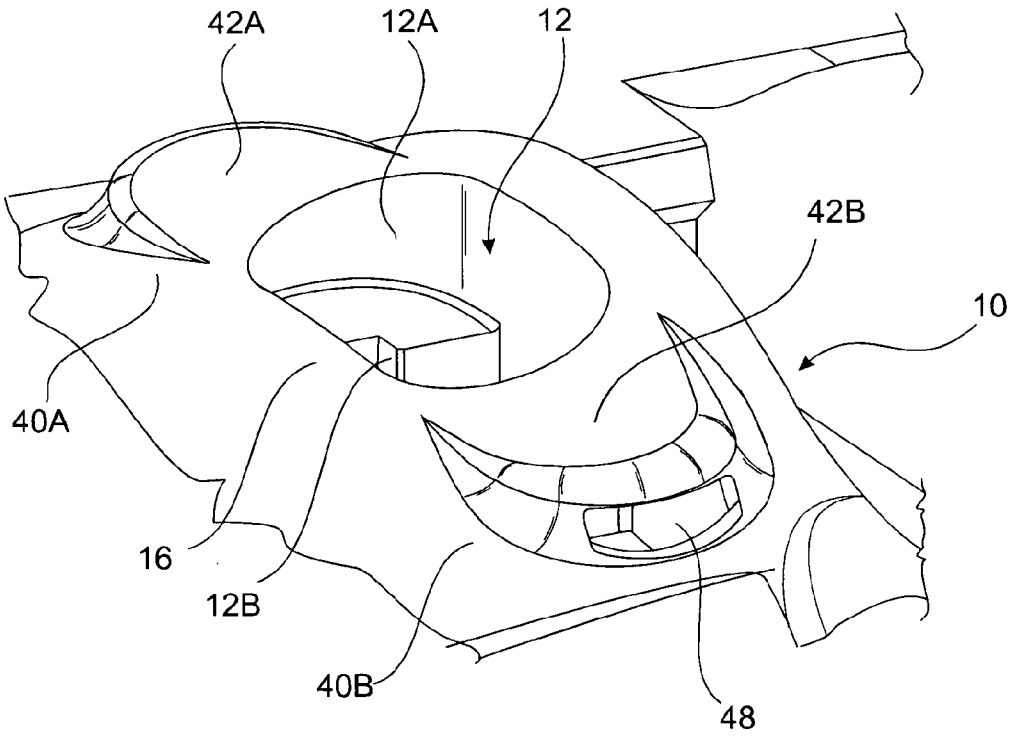
FIG. 2 is a perspective view like FIG. 1, however, seen from a different direction than in FIG. 1.
Figure 3:
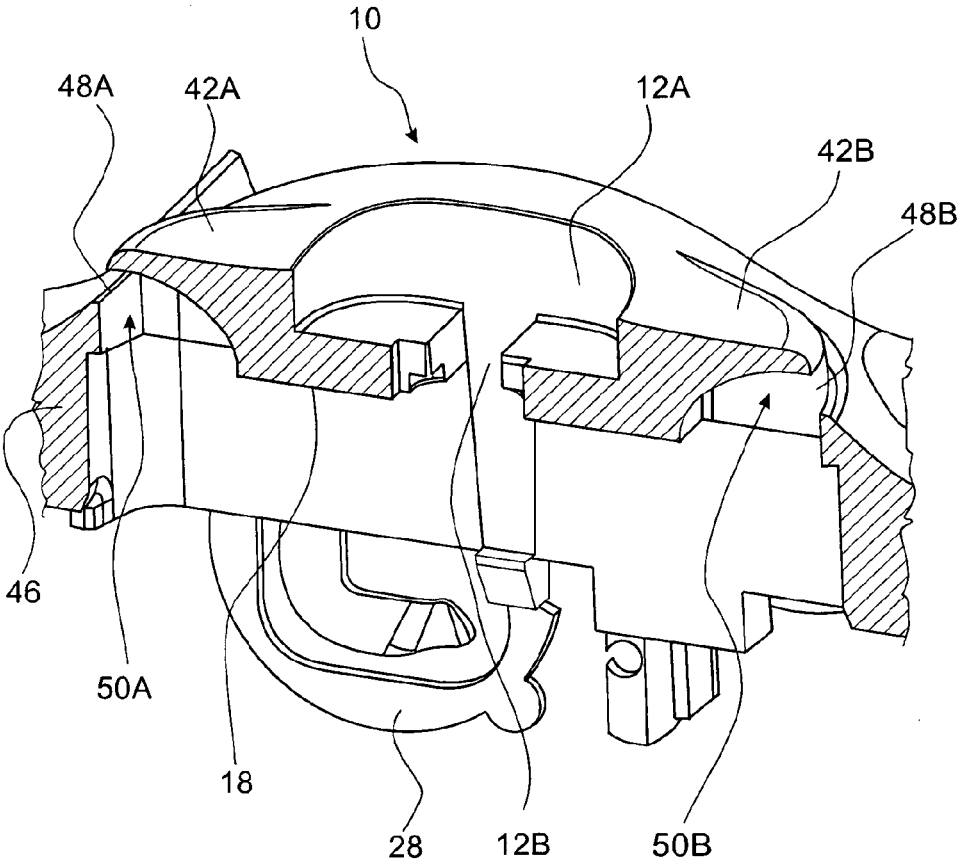
FIG. 3 is a longitudinal sectional view of the faceplate of FIGS. 1 and 2, seen in a third direction.
Figure 4:
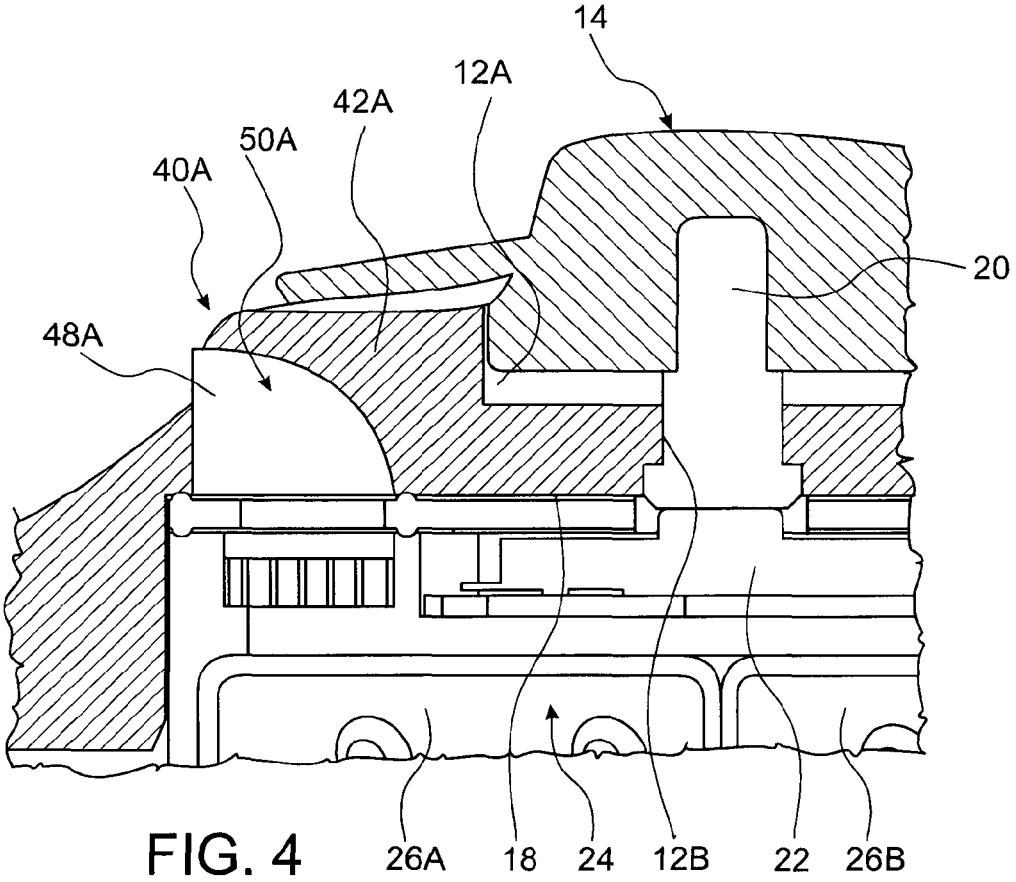
FIG. 4 is a partial longitudinal sectional view of the faceplate of FIGS. 1 to 3, with, in addition, a central button and part of a microphone module connected to the faceplate being shown.

An example of such faceplate 10 to be used with the present invention is shown in FIGS. 1 to 3. The faceplate 10 comprises a central interface opening 12 through which a user interface element, such as a button 14 (see, FIG. 4) may extend. In the example of FIGS. 1 to 4 the interface opening 12 comprises an outer wider part 12A close to the outer surface 16 of the faceplate 10 and a narrower inner part 12B located at the inwardly facing surface 18 of the faceplate 10. The wider opening 12A is designed for receiving a cap portion 18 of the button 14, and the narrower portion 12B is provided for receiving a shaft element 20 carrying, at its outer end, the cap element 18. The inner end of the shaft element 20 acts on a switch element 22 provided at the outer end of a microphone module 24. The microphone module 24 is fixed at the inner side of the faceplate 10 and comprises two microphones 26A and 26B and other electronic components such as a printed circuit board, a magnetic switch and a battery contact (these electronic components are not shown in FIG. 4, while an example of a battery contact 28 is shown in FIG. 3).

Figure 5:
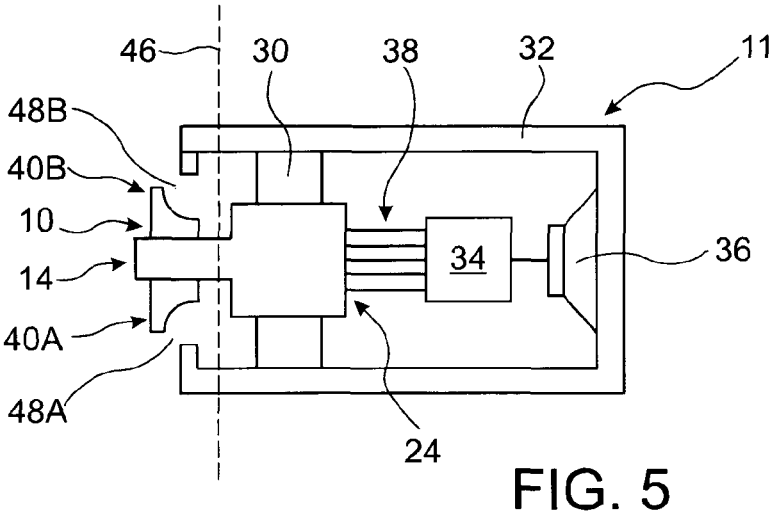
FIG. 5 is schematic longitudinal sectional view of an example of an ITE hearing aid according to the invention.

As is schematically shown in FIG. 5, the microphone module 24 is electrically connected via wires 38 to a signal processing unit 34 for processing audio signals captured by the microphone 26A, 26B and for controlling the hearing aid 11. The hearing aid 11 further comprises a loudspeaker 36 for generating sound according to the processed audio signals, with the generated sound being emitted towards the eardrum of the user. The hearing aid 11 also comprises a shell 32 which houses these components and which is closed by the faceplate 10 at its outer opening. The hearing aid also comprises a battery compartment 30.

As shown in detail in FIGS. 1 to 3, the faceplate 10 comprises a sound port 40A, 40B for each of the microphones 26A, 26B, respectively, which is integral in a single piece with the faceplate 10 and which serves to acoustically connect each microphone 26A, 26B to ambience. Each sound port 40A, 40B comprises a cover element 42A, 42B for covering a cavity 44A, 44B of the sound port 40A, 40B in a direction normal to a main plane 46 of the faceplate 10. The main plane 46 of the faceplate 10 is oriented such that it extends essentially across the hearing aid and the ear channel when the hearing aid is inserted in the ear channel. The sound port 40A, 40B also comprises a lateral sound opening 48A, 48B in a wall 50A, 50B extending substantially normal to the main plane 46 of the faceplate 10. The cover element 42A, 42B is elevated above the surface region of the faceplate 10 surrounding the cover element 42A, 42B. The wall 50A, 50B comprising the lateral sound opening 48A, 48B extends between the cover element 42A, 42B and the surface region of the faceplate 10 surrounding the cover element 42A, 42B.

Preferably, the sound opening 48A, 48B has a slot-like shape, with the longitudinal direction of the sound opening 48A, 48B being essentially parallel to the main plane 46 of the faceplate 10. As shown in the example of FIGS. 1 to 3, the sound opening 48A, 48B may be curved around a direction normal to the main plane 46 of the faceplate 10.

Preferably, the surface of the cover element 42*a*, 42*b* is substantially flat.

The cavity 44A, 44B preferably has a volume of at least 1 $mm^3$ in order to prevent capillary effects.

In the example shown in FIGS. 1 to 3 the two sound ports 40A, 40B are arranged substantially symmetrically with regard to the interface opening 12, i.e., with regard to the button 14. Preferably, the distance between the two sound ports, or more precisely, the distance between the two sound openings 48A, 48B, is at least 6.0 mm in order to improve acoustic properties, in particular, to reduce noise level in an acoustic beamforming mode of the microphones 26A, 26B.

When manufacturing the hearing aid, the shell and the faceplate are produced, the microphone module is attached to the faceplate, the other components of the hearing aid are mounted within the shell, and finally the faceplate, together with the microphone module, is fixed in the opening of the shell in order to close the shell.

The faceplate 10 preferably is produced by a molding process, such as an injection molding process.

Alternatively or in addition to the user interface opening 12 with the button 14, the faceplate may comprise an opening covered by a battery lid and/or a volume control extending through an opening of the faceplate (not shown in the figures).

What is claimed is:

1. An ITE hearing aid, comprising:

a shell to be worn at least in part in an ear canal of a user, a faceplate fixed to the shell for closing the shell at a side oriented towards the exterior of the user's ear, and at least one microphone housed in the shell and acoustically connected to ambience via a sound port, wherein the sound port is formed as one piece with the faceplate and comprises a cover element for covering a cavity of the sound port in a direction normal to a main plane of the faceplate, wherein the sound port comprises a sound opening, wherein said sound opening is laterally positioned in a wall and extends substantially normal to the main plane of the faceplate, wherein the cover element is elevated above a surface region of the faceplate surrounding the cover element, wherein said wall in which the lateral sound opening is located extends between the cover element and the surface region of the faceplate surrounding the cover element, and wherein the shell has a shape and size that enables the hearing aid to be manually removable from the ear canal without use of a tool.

2. The hearing aid of claim 1, wherein the sound opening is slot-shaped.

3. The hearing aid of claim 2, wherein a longitudinal direction of the sound opening is substantially parallel to the main plane of the faceplate.

4. The hearing aid of claim 3, wherein the sound opening is curved around a direction normal to the main plane of the faceplate.

5. The hearing aid of claim 1, wherein the cover element is substantially flat.

6. The hearing aid of claim 1, further comprising a manually operable user interface element extending through an interface opening in the faceplate.

7. The hearing aid of claim 6, wherein the user interface element comprises a button operable in a direction normal to the main plane of the faceplate.

8. The hearing aid of claim 6, wherein the faceplate comprises an opening covered by a battery lid.

9. The hearing aid of claim 6, further comprising a volume control extending through an opening of the faceplate.

10. The hearing aid of claim 6, wherein said at least one microphone comprises two microphones with a separate sound port being provided for each of the microphones.

11. The hearing aid of claim 10, wherein the two sound ports are arranged substantially symmetrically with regard to the interface opening.

12. The hearing aid of claim 11, wherein the distance between the sound openings of the sound ports is at least 6.0 mm.

13. The hearing aid of claim 1, wherein the at least one microphone forms part of a microphone module fixed at the inner side of the faceplate.

14. The hearing aid claim 1, wherein the cavity of the sound port has a volume of at least 1 $mm^3$.

* * * * *